US009786998B2

(12) United States Patent
Liu et al.

(10) Patent No.: US 9,786,998 B2
(45) Date of Patent: Oct. 10, 2017

(54) SMART ANTENNA MODULE AND OMNI-DIRECTIONAL ANTENNA THEREOF

(71) Applicant: Wistron NeWeb Corporation, Hsinchu (TW)

(72) Inventors: An-Shyi Liu, Hsinchu (TW); Cheng-Geng Jan, Hsinchu (TW); Chung-Han Hsieh, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 159 days.

(21) Appl. No.: 14/882,461

(22) Filed: Oct. 14, 2015

(65) Prior Publication Data

US 2016/0302081 A1 Oct. 13, 2016

(30) Foreign Application Priority Data

Apr. 7, 2015 (TW) ..... 104111141 A

(51) Int. Cl.

| | |
|---|---|
| ***H01Q 21/29*** | (2006.01) |
| ***H01Q 3/44*** | (2006.01) |
| ***H01Q 19/32*** | (2006.01) |
| ***H01Q 25/00*** | (2006.01) |
| ***H01Q 1/22*** | (2006.01) |

(52) U.S. Cl.

CPC ..... *H01Q 21/29* (2013.01); *H01Q 3/446* (2013.01); *H01Q 19/32* (2013.01); *H01Q 1/2291* (2013.01); *H01Q 25/00* (2013.01)

(58) Field of Classification Search

None

See application file for complete search history.

(56) References Cited

U.S. PATENT DOCUMENTS

| | | | | |
|---|---|---|---|---|
| 7,652,632 | B2 * | 1/2010 | Shtrom | H01Q 1/38 343/700 MS |
| 2006/0044205 | A1 * | 3/2006 | Lynch | H01Q 1/243 343/833 |
| 2008/0012778 | A1 * | 1/2008 | Mitsui | H01Q 1/2275 343/812 |
| 2012/0062432 | A1 | 3/2012 | Wu | |
| 2014/0187174 | A1 | 7/2014 | Safavi | |
| 2014/0313080 | A1 * | 10/2014 | Smith | H01Q 3/00 342/372 |
| 2015/0022417 | A1 * | 1/2015 | Pan | H01Q 1/48 343/843 |

* cited by examiner

*Primary Examiner* — Diane Lo

(74) *Attorney, Agent, or Firm* — Winston Hsu

(57) ABSTRACT

A smart antenna module includes an omni-directional antenna and at least one reflecting unit for adjusting a radiation pattern of the smart antenna module, wherein the one reflecting unit includes a reflector and a switch coupled between the reflector and a ground of the omni-directional antenna for electrically connecting the reflector with the ground or separating the reflector from the ground according to a control signal to adjust the radiation pattern of the smart antenna module.

19 Claims, 15 Drawing Sheets

SMART ANTENNA MODULE AND OMNI-DIRECTIONAL ANTENNA THEREOF

BACKGROUND OF THE INVENTION

1. Field of the Invention

The present invention relates to a smart antenna module and omni-directional antenna thereof, and more particularly, to a smart antenna module and omni-directional antenna thereof having a radiation pattern which is adjusted by adjusting the ground state of at least one reflecting unit.

2. Description of the Prior Art

As the growth of number of wireless communication users, the co-channel fading, which degrades the transmission quality and limits the frequency efficiency, increases significantly. Traditionally, one resolution to overcome this problem is the incorporation of the smart antenna. In general, a smart antenna may refer to an adaptive antenna or a switched-beam antenna.

An adaptive antenna aims to reject the interference signals automatically by modifying its radiation pattern. However, it requires a complex RF circuit to synthesize the antenna steering beam. The other solution, i.e. the switched-beam antenna, only requires a set of switches to control the steering beam. Therefore, using the switched-beam antenna is much cost-effective.

The switched-beam antenna supporting WiFi 802.11b/g/n for an access point (AP) had been applied since several years ago. However, with the advance of wireless communication technology, the wireless communication devices may be configured with an increasing number of antennas. For example, a wireless local area network standard IEEE 802.11n supports multi-input multi-output (MIMO) communication technology, i.e. an wireless communication device is capable of concurrently receiving/transmitting wireless signals via multiple (or multiple sets of) antennas, to vastly increase system throughput and transmission distance without increasing system bandwidth or total transmission power expenditure, thereby effectively enhancing spectral efficiency and transmission rate for the wireless communication system, as well as improving communication quality.

As can be seen from the above, a prerequisite for implementing techniques, such as spatial multiplexing, beam forming, spatial diversity, pre-coding, etc., employed in the MIMO communication technology is to employ multiple sets of antenna to divide a space into many channels in order to provide multiple antenna field patterns. Therefore, it is a common goal in the industry to design antennas that suit both transmission demands, as well as dimension and functionality requirements.

SUMMARY OF THE INVENTION

It is therefore an objective of the present invention to provide a smart antenna module and omni-directional antenna thereof having a radiation pattern which is adjusted by adjusting the ground state of at least one reflecting unit to carry out beam steering.

An embodiment of the present invention discloses a smart antenna module, including an omni-directional antenna and at least one reflecting unit. The at least one reflecting unit is used for adjusting a radiation pattern of the smart antenna module, wherein each of the at least one reflecting unit includes a reflector and a switch. The switch is coupled between the reflector and a ground of the omni-directional antenna for electrically connecting the reflector with the ground or separating the reflector from the ground according to a control signal to adjust the radiation pattern of the smart antenna module.

Another embodiment of the present invention further discloses an omni-directional antenna including a ground, a feed point and a radiator. The feed point is electrically connected to a wireless signal. The radiator is electrically connected to the feed point for resonating the wireless signal, wherein the radiator includes a first arm electrically connected to the feed point and extending along a first direction from the feed point, a second arm electrically connected to the first arm and extending along a second direction from the first arm, and a third arm electrically connected between the second arm and the ground, wherein the third arm includes a first bend, a first branch electrically connected between the second arm and the first bend and extending along a third direction from the second arm, and a second branch electrically connected between the first bend and the ground and extending along an opposite direction of the first direction from the first bend, a fourth arm electrically connected to the first arm and extending along an opposite direction of the second direction from the first arm, and a fifth arm electrically connected between the fourth arm and the ground, wherein the fifth arm includes a second bend, a third branch electrically connected between the fourth arm and the second bend and extending an opposite direction of the third direction from the fourth arm, and a fourth branch electrically connected between the second bend and the ground and extending along the opposite direction of the first direction from the second bend. The first direction, the second direction and the third direction are perpendicular to each other.

These and other objectives of the present invention will no doubt become obvious to those of ordinary skill in the art after reading the following detailed description of the preferred embodiment that is illustrated in the various figures and drawings.

DETAILED DESCRIPTION

A smart antenna module of the present invention has two operation modes including an omni-directional mode and a directional mode. When the smart antenna module operates in the omni-directional mode, a radiation pattern of the smart antenna module may be an omni-directional radiation pattern for transmitting and receiving the wireless signal from all horizontal directions. On the other hand, when the smart antenna module operates in the directional mode, the radiation pattern of the smart antenna module may be a directional radiation pattern once a direction of the source of the wireless signal is confirmed. In addition, a direction of a main beam of the directional radiation pattern may also be adaptively adjusted to substantially face the direction of the source of the wireless signal, so as to perform the beam steering. As a result, the smart antenna module may be used as a switched-beam antenna to switch to either the omni-directional radiation pattern or the directional radiation pattern, thereby the co-channel fading may be improved and data throughput of the smart antenna module may be increased.

Figure 1:
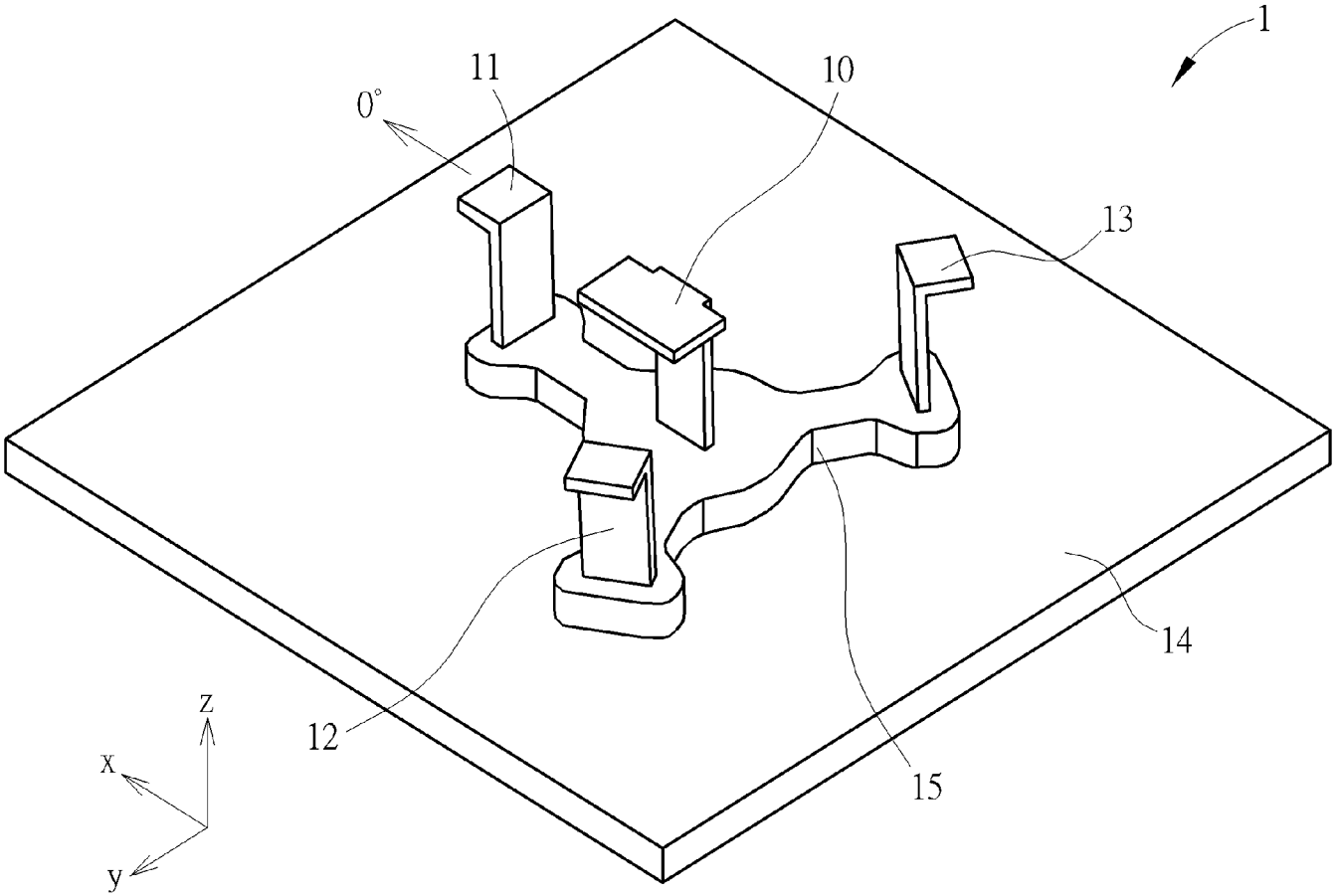
FIG. 1 is a schematic diagram of a smart antenna module according to an embodiment of the present invention.

Specifically, FIG. 1 is a schematic diagram of a smart antenna module 1 according to an embodiment of the present invention. The smart antenna module 1 may be integrated into electronic devices having the wireless communication functions such as wireless access points, personal computers, or laptop computers. The aforementioned electronic devices may be configured with a plurality of the smart antenna modules 1 to support multiple-input multiple-output communication technology. A wireless signal processing module and/or other signal processing units built-in the electronic device may be coupled to the smart antenna module 1 for generating at least one control signal to the smart antenna module 1. Therefore, the radiation pattern of the smart antenna module 1 may be adjusted to perform the beam steering according to the control signal.

In structure, the smart antenna module 1 includes an omni-directional antenna 10, reflecting units 11, 12 and 13, a substrate 14 and a holder 15. A ground GND (not shown in FIG. 1) may be formed on the substrate 14. The reflecting units 11, 12 and 13 may respectively be electrically connected to the ground GND or separated from the ground GND according to the corresponding control signal to adjust a radiation pattern of the smart antenna module 1. The omni-directional antenna 10, the reflecting units 11, 12 and 13 and the holder 15 may be disposed on a first surface of the substrate 14 (for example, a top surface). The holder 15 may be coupled to the omni-directional antenna 10 and the reflecting units 11, 12 and 13, for fixing the omni-directional antenna 10 and the reflecting units 11, 12 and 13.

In operation, when the smart antenna module 1 is operating in the omni-directional mode, the radiation pattern of the smart antenna module 1 may be an omni-directional pattern and all of the reflecting units 11, 12 and 13 are set at floating states. On the other hand, when the smart antenna module 1 is operating in the directional mode, one of the reflecting units 11, 12 and 13 is electrically connected to the ground GND, wherein one of the reflecting units 11, 12 and 13 may be regarded as a portion of the omni-directional antenna 10 for reflecting the omni-directional pattern of the smart antenna module 1, so that the radiation pattern of the smart antenna module 1 is the directional pattern. Moreover, a direction of a main beam of the directional pattern is substantially parallel to a direction from the reflecting unit electrically connected to the ground GND toward the omni-directional antenna 10. For example, the reflecting unit 11 may be regarded as a portion of the omni-directional antenna 10 for reflecting the radiation pattern of the smart antenna module 1 when the reflecting unit 11 is grounded and the reflecting units 12 and 13 are floating, wherein the direction of the main beam of the directional pattern is substantially parallel to the direction from the reflecting unit 11 toward the omni-directional antenna 10 (i.e., an opposite direction of the x-direction).

As a result, the radiation pattern of the smart antenna module may be adjusted to the directional pattern by electrically connecting one of the reflecting units 11, 12 and 13 to the ground GND via the control signal, wherein the direction of the main beam may be one of three different directions. In an embodiment, the reflecting units 11, 12 and 13 may be evenly disposed around the omni-directional antenna 10, and lines from two adjacent reflecting units toward the omni-directional antenna 10 may form a central angle, wherein the two adjacent reflecting units may be the reflecting units 11 and 12, the reflecting units 12 and 13 or the reflecting units 11 and 13 for example. The central angle may be equal to 360/N, where N is a number of the reflecting units. In the embodiment shown in FIG. 1, the number N is 3 and the central angle is 120 degrees. Therefore, assuming that the x-direction is at 0 degree, then the reflecting units 11, 12 and 13 will be disposed at 0 degree, 120 degrees and 240 degrees around the omni-directional antenna 10, respectively. The direction of the main beam is substantially parallel to the direction from the reflecting unit 11 toward the omni-directional antenna 10 (i.e., the direction of 180 degrees) when the reflecting unit 11 is connected to the ground. The direction of the main beam is substantially parallel to the direction from the reflecting unit 12 toward the omni-directional antenna 10 (i.e., the direction of 300 degrees) when the reflecting unit 12 is connected to the ground. The direction of the main beam is substantially parallel to the direction from the reflecting unit 13 toward the omni-directional antenna 10 (i.e., the direction of 60 degrees) when the reflecting unit 13 is connected to the ground.

In other words, the smart antenna module 1 of the present invention may control the reflecting units 11, 12 and 13 being connected to the ground GND and separated from the ground GND to adjust the radiation pattern of the smart antenna module 1. When the smart antenna module operates in the omni-directional mode, the radiation pattern of the smart antenna module 1 may be the omni-directional radiation pattern and all of the reflecting units 11, 12, 13 are separated from the ground GND. On the other hand, when the smart antenna module 1 operates in the directional mode, the radiation pattern of the smart antenna module 1 may be the directional radiation pattern and one of the reflecting units 11, 12 and 13 is connected to the ground GND once the direction of the source of the wireless signal is confirmed. As a result, the smart antenna module 1 of the present invention may be used as the switched-beam antenna to switch to either the omni-directional radiation pattern or the directional radiation pattern, thereby the co-channel fading may be improved and data throughput of the smart antenna module can be increased.

Noticeably, the smart antenna module 1 in FIG. 1 is one of various embodiments of the present invention. Those skilled in the art may make modifications and alterations accordingly, which is not limited to the embodiments of the present invention. For example, when the smart antenna module 1 is operating in the directional mode, two adjacent reflecting units of the reflecting units 11, 12 and 13 may be electrically connected to the ground GND, which allows the radiation pattern of the smart antenna module 1 to be a directional pattern, wherein the direction of the main beam of the directional pattern is substantially parallel to a direction from a middle point between two adjacent reflecting units electrically connected to the ground GND toward the omni-directional antenna 10. As a result, the directions of beam steering may be more flexible. For example, the direction of the main beam is substantially parallel to the direction from the middle point between two adjacent reflecting units 11 and 12 toward the omni-directional antenna 10 (i.e., the direction of 240 degrees) when the reflecting units 11 and 12 are connected to the ground. The direction of the main beam is substantially parallel to the direction from the middle point between two adjacent reflecting units 12 and 13 toward the omni-directional antenna 10 (i.e., the direction of 0 degree) when the reflecting units 12 and 13 are connected to the ground. The direction of the main beam is substantially parallel to the direction from the middle point between two adjacent reflecting units 11 and 13 toward the omni-directional antenna 10 (i.e., the direction of 120 degrees) when the reflecting units 11 and 13 are connected to the ground. The direction of the main beam corresponding to the ground states of the reflecting units may be categorized into the following Table 1:

TABLE 1

| Position of the reflecting units | 0 degree | 120 degrees | 240 degrees | Direction of the main beam |
|---|---|---|---|---|
| Ground state | | V | V | 0 degree |
| Grounded: V | | | V | 60 degrees |
| Floating: blank | V | | V | 120 degrees |
| | V | | | 180 degrees |
| | V | V | | 240 degrees |
| | | V | | 300 degrees |

Therefore, the smart antenna module 1 of the present invention may be switched to one of six different directions of the main beam via adjusting the ground states of the reflecting units. As a result, the beam steering may be more flexible.

Figure 2:
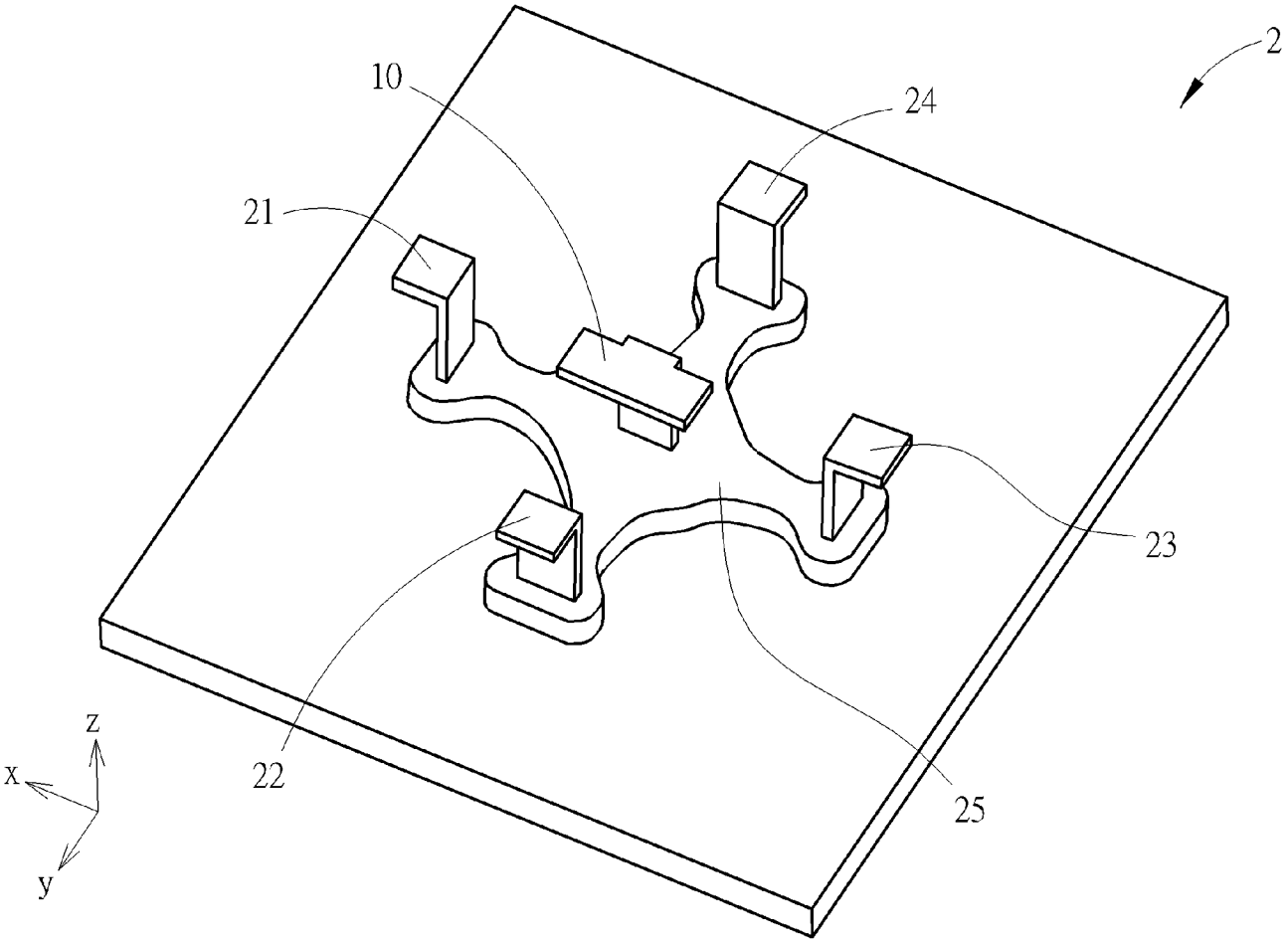
FIG. 2 is a schematic diagram of another smart antenna module according to an embodiment of the present invention.

In addition, relative positions between the reflecting units 11, 12 and 13 and the omni-directional antenna 10 may be adjusted according to practical requirements, which is not limited to the embodiment in FIG. 1. For example, the central angle between the reflecting units 11, 12 and 13 and the omni-directional antenna 10 may be any degrees. In an embodiment, one or multiple of the reflecting units 11, 12 and 13 may be disposed close to or distant from the omni-directional antenna 10. The number N may be an integer at least greater than 1 according to practical application requirements. In an embodiment, the number N of the reflecting units may be 3 or 4. FIG. 2 is a schematic diagram of another smart antenna module 2 according to an embodiment of the present invention. A difference between the smart antenna module 1 and the smart antenna module 2 is that a number N of the reflecting units of the smart antenna module 2 is 4.

In structure, the smart antenna module 2 includes reflecting units 21, 22, 23 and 24. Assuming that the x-direction is at 0 degree, then the reflecting units 21, 22, 23 and 24 may be disposed at 0 degree, 90 degrees, 180 degrees and 270 degrees around the omni-directional antenna 10, respectively. A holder 25 of the smart antenna module 2 may be coupled to the omni-directional antenna 10 and the reflecting units 21, 22, 23 and 24 to enhance a firmness of the omni-directional antenna 10 and the reflecting units 21, 22, 23, 24.

In operation, when the smart antenna module 2 is operating in the omni-directional mode, the radiation pattern of the smart antenna module 2 may be the omni-directional radiation pattern and all of the reflecting units 21, 22, 23 and 24 are set at floating states. On the other hand, when the smart antenna module 2 is operating in the directional mode, the smart antenna module 2 may be switched to eight different directions of the main beam, so that the beam steering may be more flexible. The direction of the main beam corresponding to the ground states of the reflecting units may be categorized into the following Table 2:

TABLE 2

| Position of the reflecting units | 0 degree | 90 degrees | 180 degrees | 270 degrees | Direction of the main beam |
|---|---|---|---|---|---|
| Ground state | | | V | | 0 degree |
| Grounded: V | | | V | V | 45 degrees |
| Floating: blank | | | | V | 90 degrees |
| | V | | | V | 135 degrees |
| | V | | | | 180 degrees |
| | V | V | | | 225 degrees |
| | | V | | | 270 degrees |
| | | V | V | | 315 degrees |

Therefore, the smart antenna module of the present invention may be switched to one of different directions of the main beam via adjusting the ground states of the reflecting units and increasing the number of the reflecting units. As a result, the beam steering may be more flexible.

Figure 3:
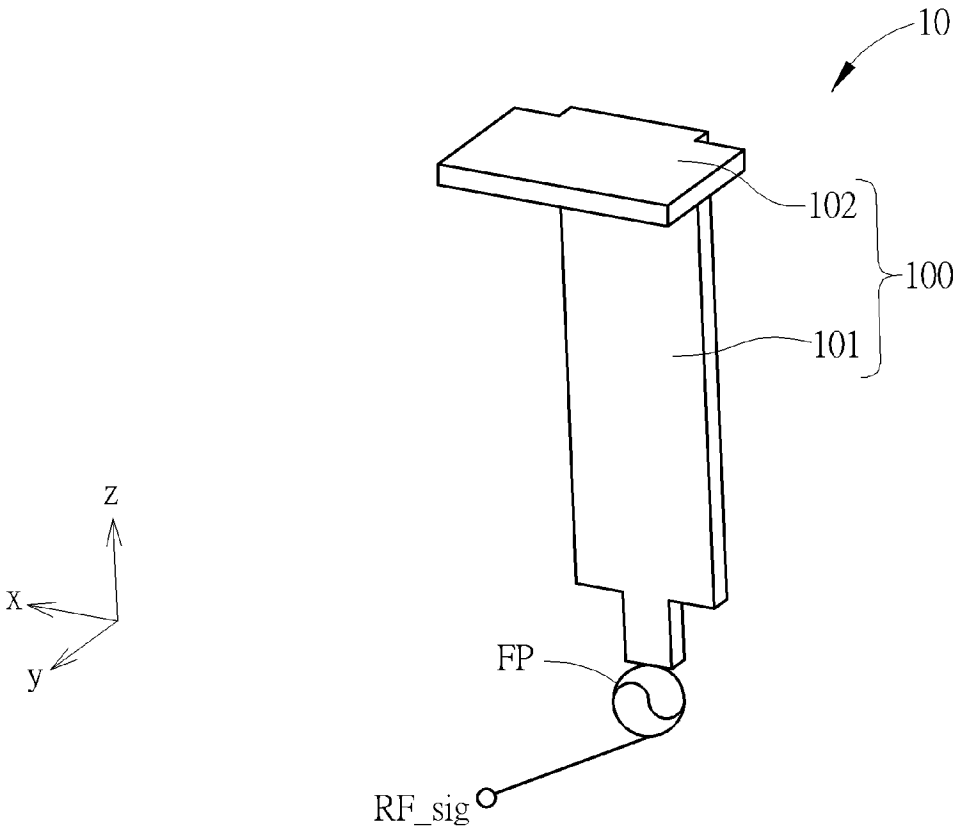
FIG. 3 is a schematic diagram of an omni-directional antenna in FIG. 1 according to an embodiment of the present invention.

FIG. 3 is a schematic diagram of the omni-directional antenna 10 according to an embodiment of the present invention. As shown in FIG. 3, the omni-directional antenna 10 includes a feed point FP and a radiator 100. The radiator 100 may be electrically connected to the feed point FP for resonating a wireless signal RF_sig. The radiator 100 includes arms 101 and 102. The arm 101 may be electrically connected to the feed point FP and extend along a z-direction from the feed point FP. The arm 102 may be electrically connected to the arm 101 and extend along the x-direction. The omni-directional antenna 10 may be a T-shaped monopole antenna or a bended-monopole antenna which is vertical polarized. The x-direction, y-direction and z-direction are perpendicular to each other.

Figure 4:
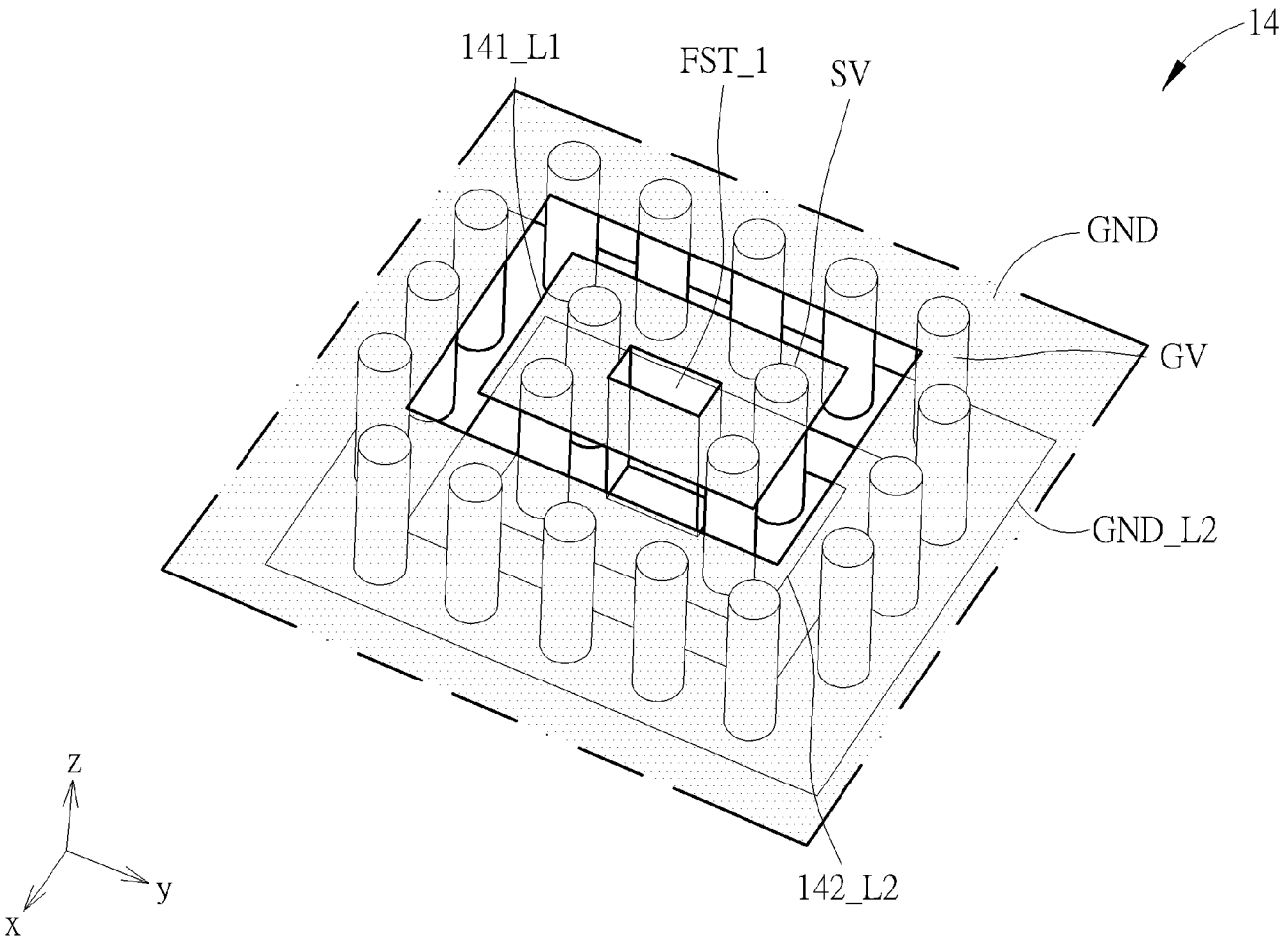
FIG. 4 is a feed structure diagram of the omni-directional antenna in FIG. 1 according to an embodiment of the present invention.

FIG. 4 illustrates a perspective view of a feed-in structure of the omni-directional antenna 10 according to an embodiment of the present invention. A pad 141_L1 and the ground GND may be formed on the first surface (i.e., the top surface) of the substrate 14, and the radiator 100 may be disposed on the first surface of the substrate 14 by soldering. A pad 142_L2 and a ground GND_L2 may be formed on the second surface (i.e., the bottom surface) of the substrate 14. The pad 142_L2 may be used as the feed point FP for feeding the wireless signal RF_sig. A plurality of ground vias GV and a plurality of signal vias SV may be formed inside the substrate 14, the ground vias GV may be used for electrically connecting the ground GND and the ground GND_L2, and the signal vias SV may be used for electrically connecting the pad 141_L1 and the pad 142_L2. Moreover, a slot FST_1 may be formed in the substrate 14, and the radiator 100 may be inserted into the slot FST_1 to fix the radiator 100.

Figure 5:
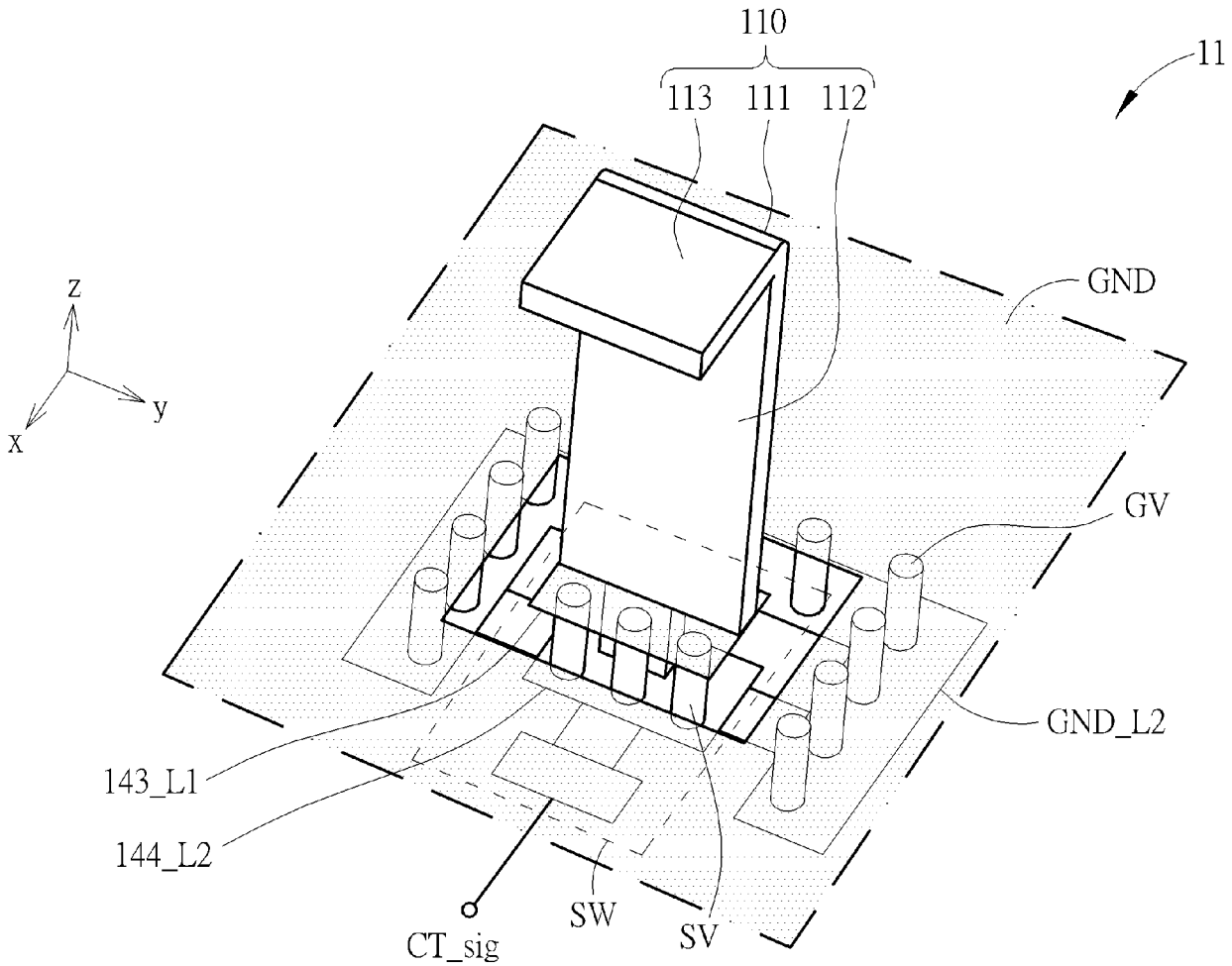
FIG. 5 is a schematic diagram of a reflecting unit in FIG. 1 according to an embodiment of the present invention.

FIG. 5 illustrates a perspective view of the reflecting unit 11 according to an embodiment of the present invention. The reflecting units 11, 12 and 13 illustrated in FIG. 1 and the reflecting units 21, 22, 23 and 24 illustrated in FIG. 2 are structurally identical, herein takes the reflecting unit 11 for example. As shown in FIG. 5, the reflecting unit 11 includes a reflector 110 and a switch SW. The switch SW may be coupled between the reflector 110 and the ground GND for electrically connecting the reflector 110 with the ground GND (and the GND_L2) or separating the reflector 110 from the ground GND (and the GND_L2), according to a control signal CT_sig, to adjust the radiation pattern of the smart antenna module 1. The control signal CT_sig may be a general purpose I/O (GPIO) signal generated by the wireless signal processing module and/or other signal processing units in the electronic device to control the ground state of the reflecting unit 11.

The reflector 110 includes a bend 111 and arms 112 and 113. The arm 112 may be coupled between the switch and the bend 111 and extend along the z-direction from the switch SW. One end of the arm 113 may be electrically connected to the bend 111, and another end of the arm 113 may be open. The arm 113 may extend from the bend 111 along a direction from the omni-directional antenna 10 toward the reflector 110 (i.e., the x-direction), but not limited thereto. In another embodiment, the arm 113 of the reflector which is open may extend from the bend 111 along a direction from the reflector 110 toward the omni-directional antenna 10 (i.e., the opposite direction of the x-direction).

A pad 143_L1 and the ground GND may be formed on the first surface of the substrate 14, and the reflector 110 may be formed on the first surface of the substrate 14 by soldering. A pad 144_L2 and the ground GND_L2 may be formed on the second surface of the substrate 14. The signal vias SV may be used for electrically connecting the pad 143_L1 and the pad 144_L2. In addition, the ground vias GV may be formed around the switch SW for electrically connecting the ground GND and the ground GND_L2. The switch SW may be disposed on the second surface of the substrate 14 in opposite to the first surface on which the radiator 100 is disposed. Such a configuration may be beneficial for manufacturing.

Figure 6:
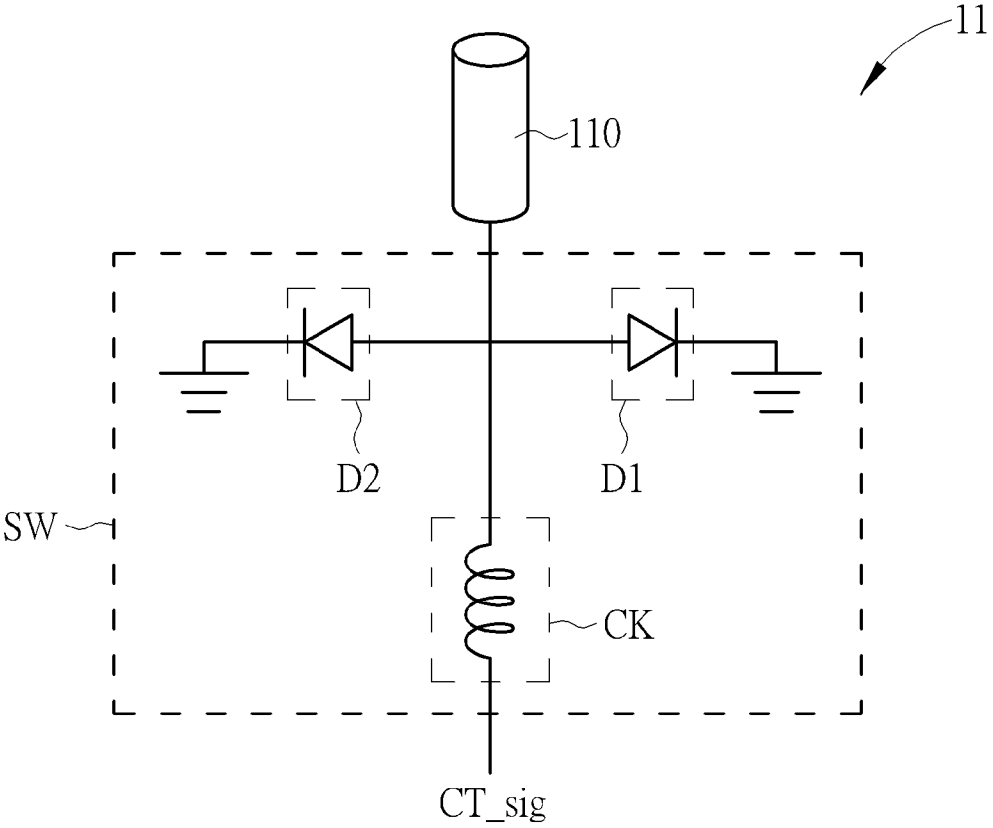
FIG. 6 is an equivalent circuit diagram of the reflecting unit in FIG. 1 according to an embodiment of the present invention.

FIG. 6 is an equivalent circuit diagram of the reflecting unit 11 according to an embodiment of the present invention. The switch SW may be coupled between the reflector 110 and the ground GND for electrically connecting the reflector 110 with the ground GND or separating the reflector 110 from the ground GND, according to the control signal CT_sig, to adjust the radiation pattern of the smart antenna module 1.

The switch SW includes at least one switch device (diodes D1 and D2 are used as an example in the present embodiment) and a radio-frequency choke device CK. Anodes of the diodes D1 and D2 of the present embodiment are coupled to the reflector 110, and cathodes of the diodes D1 and D2 may be coupled to the ground GND. Once two diodes are turned on to enhance the conductivity between the reflector 110 and the ground GND, the directivity of the main beam of the smart antenna module 1 may be increased. In other embodiments, the switch SW may include three (or more) switch devices or a single switch device. The switch device may be a PIN-diode (P-intrinsic-N Diode) or any radio-frequency switching device which is capable of being used as the switch, such as a PN diode, a transistor or a microelectromechanical system (MEMS). The radio-frequency choke device CK may have one end coupled to the control signal CT_sig, and another end coupled to the anodes of the diodes D1 and D2 and the reflector 110 to prevent the total stability and characteristics of the antenna from being influenced by the control signal CT_sig, and also prevent noise currents of the CT_sig from being transmitted to the ground GND and the reflecting units. In addition, the radio-frequency choke device CK may prevent signals of the ground GND and the reflector 110 from being transmitted to the control signal CT_sig.

In operation, the diodes D1 and D2 may be simultaneously turned on to electrically connect the reflector 110 with the ground GND when the control signal CT_sig is at a high voltage level. The diodes D1 and D2 may be simultaneously turned off to separate the reflector 110 from the ground GND when the control signal CT_sig is at a low voltage level. Therefore, the control signal CT_sig may control the ground state of the reflector 110 to adjust the radiation pattern of the smart antenna module.

Figure 7:
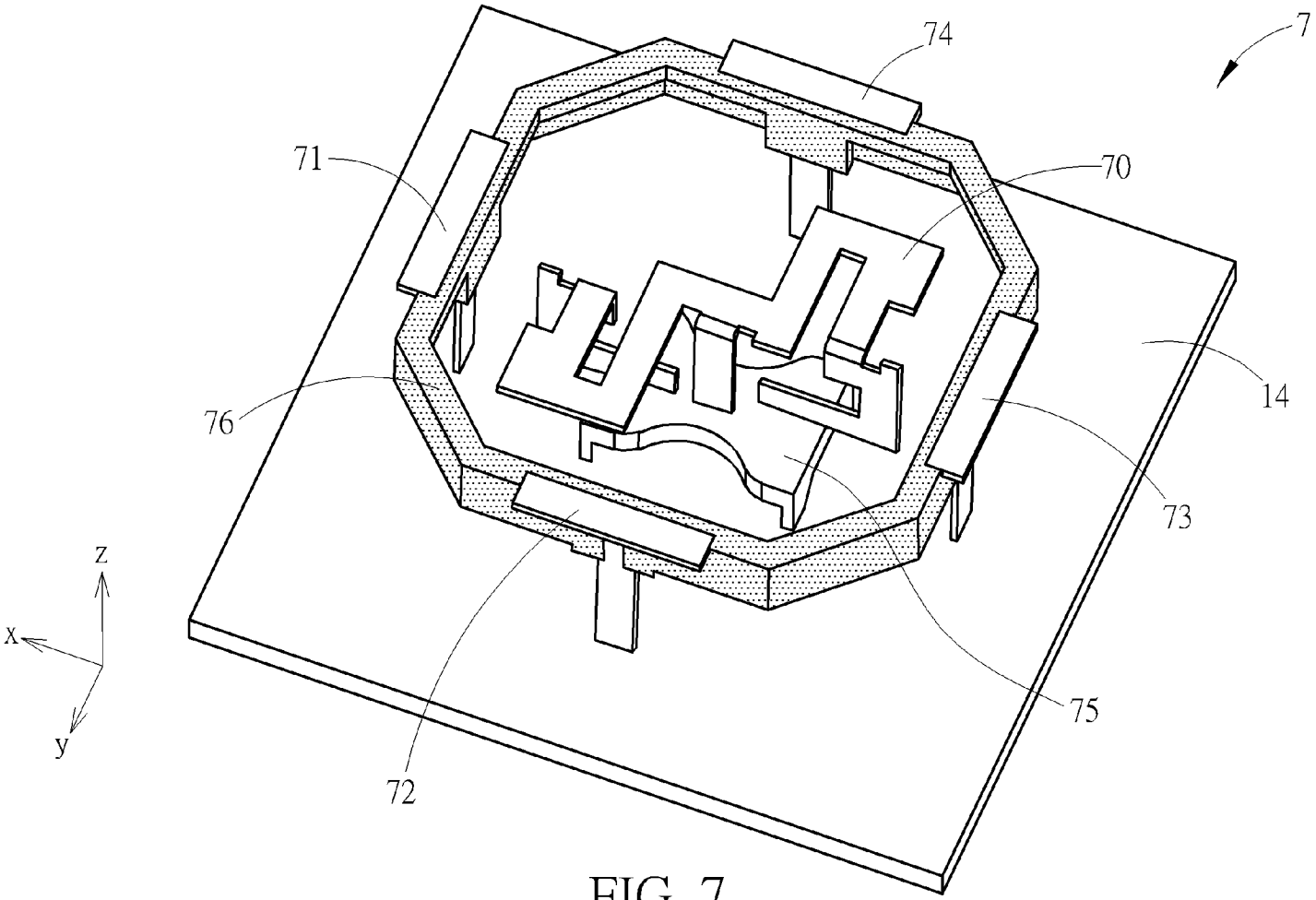
FIG. 7 is a schematic diagram of another smart antenna module according to an embodiment of the present invention.

FIG. 7 is a schematic diagram of another smart antenna module 7 according to an embodiment of the present invention. Structures and operations of the smart antenna module 2 in FIG. 2 and the smart antenna module 7 are similar. Both of them include an omni-directional antenna together with four reflecting units. Therefore, the smart antenna module 7 may be switched to one of eight different directions of the main beam, like the smart antenna module 2. A difference between the smart antenna module 7 and 2 lies in shapes of the omni-directional antenna and the reflecting units, wherein an additional holder is disposed in the smart antenna module 7 to fix the reflecting units to enhance a firmness of the reflecting units.

As shown in FIG. 7, the smart antenna module 7 includes an omni-directional antenna 70, reflecting units 71, 72, 73 and 74, a substrate 14 and holders 75 and 76. Each of the reflecting units 71, 72, 73 and 74 may be used for adjusting the radiation pattern of the smart antenna module 7 via electrically connecting with the ground GND or separating from the ground GND according to corresponding control signals. The holder 75 may be connected to the omni-directional antenna 70 to fix the omni-directional antenna 70 to enhance the firmness of the omni-directional antenna 70. The holder 76 may be used for fixing the reflecting units 71, 72, 73 and 74 to enhance the firmness of the reflecting units 71, 72, 73 and 74.

Figure 8:
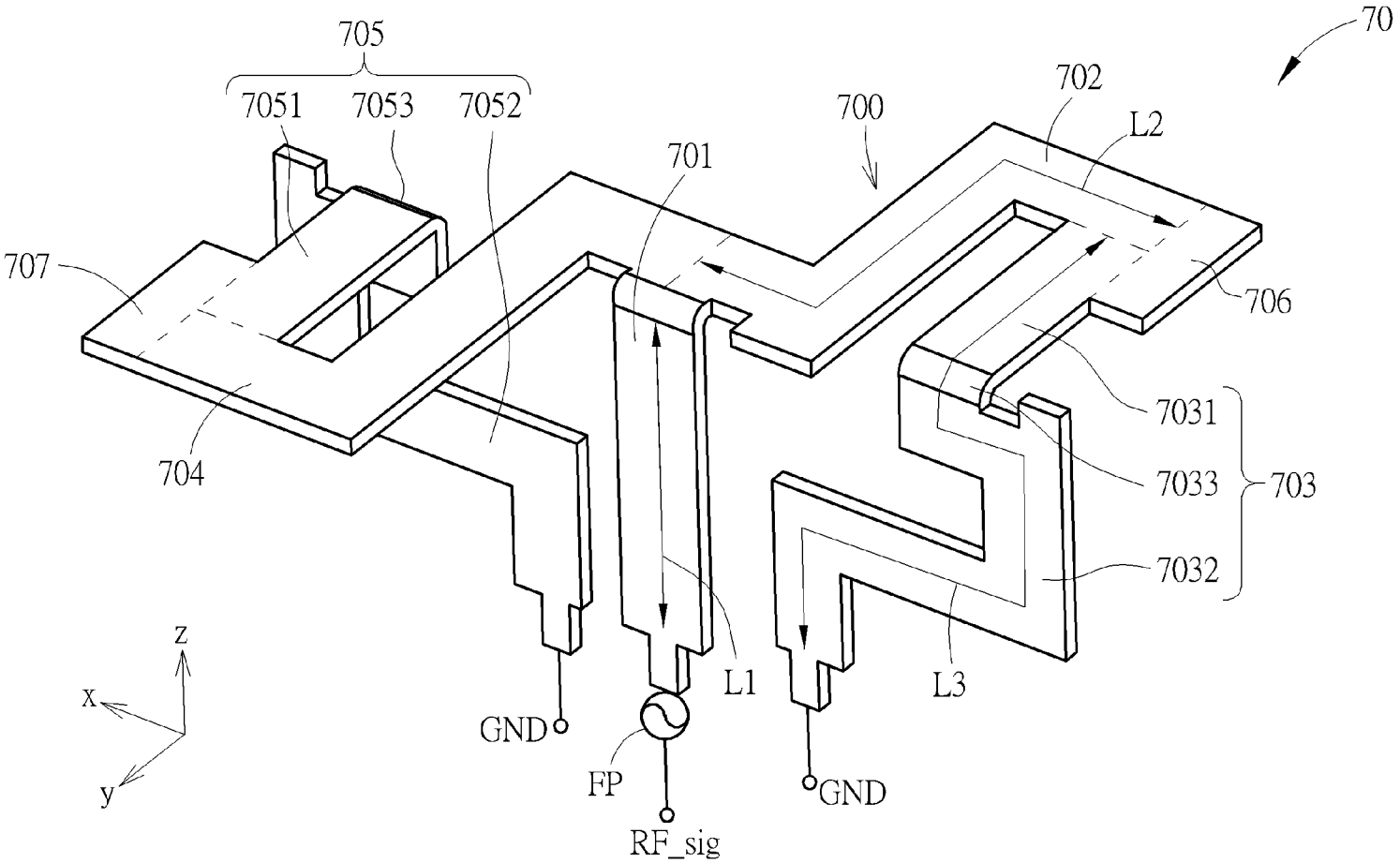
FIG. 8 is a schematic diagram of the omni-directional antenna in FIG. 7 according to an embodiment of the present invention.

FIG. 8 is a schematic diagram of the omni-directional antenna 70 according to an embodiment of the present invention. As shown in FIG. 8, the omni-directional antenna 70 includes a feed point FP and a radiator 700. The radiator 700 may be electrically connected to the feed point FP for resonating the wireless signal RF_sig. The radiator 700 includes arms 701, 702, 703, 704 and 705. The arms 703 and 705 may be electrically connected to the grounds GND. In the present embodiment, the omni-directional antenna 70 may be regarded as a dual shorted-pin monopole antenna, and this type of antenna may eliminate the harmonic frequency to optimize the radiation efficiency at the main resonant frequency.

In structure, the arm 701 may be electrically connected to the feed point FP and extend along the z-direction from the feed point FP. The arm 702 may be electrically connected to the arm 701 and extend along the opposite direction of the x-direction from the arm 701. The arm 703 may be electrically connected between the arm 702 and the ground GND. The arm 703 includes branches 7031 and 7032 and a bend 7033. The branch 7031 may be electrically connected between the arm 702 and the bend 7033 and extend along the y-direction from the arm 702. The branch 7032 may be electrically connected between the bend 7033 and the ground GND and extend along the opposite direction of the z-direction from the bend 7033.

The arm 704 may be electrically connected to the arm 701 and extend along the x-direction from the arm 701. The arm 705 may be electrically connected between the arm 704 and the ground GND, and the arm 705 includes branches 7051 and 7052 and a bend 7053. The branch 7051 may be electrically connected between the arm 704 and the bend 7053 and extend along the opposite direction of the y-direction from the arm 704. The branch 7052 may be electrically connected between the bend 7053 and the ground GND and extend along the opposite direction of the z-direction from the bend 7053.

A combination of the arm 702 and the branch 7031 of the arm 703 may form a U-shape having an opening facing the y-direction. A combination of the arm 704 and the branch 7051 of the arm 705 may form a U-shape having an opening facing the opposite direction of the y-direction. The branch 7032 of the arm 703 may form a U-shape having an opening facing the x-direction. The branch 7052 of the arm 705 may form a U-shape having an opening facing the opposite direction of the x-direction.

The arm 701 has a length L1, the arm 702 and the arm 704 have a length L2, respectively. A sum of the length L1 and the length L2 may be substantially a quarter wavelength of the wireless signal RF_sig. The arm 703 and the arm 705 have a length L3, respectively. The length L3 may be substantially the quarter wavelength of the wireless signal RF_sig. Therefore, a total length of the arms 701, 702 and 703 may be substantially a half wavelength of the wireless signal RF_sig, and a total length of the arms 701, 704 and 705 may be substantially the half wavelength of the wireless signal RF_sig.

Notably, the radiator 700 may further include open-stubs 706 and 707 for enhancing radiation efficiencies of the radiator 700 to resonate the wireless signal RF_sig and matching of the antenna. The open-stub 706 may be electrically connected to where the arm 702 is connected to the arm 703. The open-stub 707 may be electrically connected to where the arm 704 is connected to the arm 705. In other words, the open-stubs 706 and 707 may be disposed at the quarter wavelength of the wireless signal RF_sig from the feed point FP to adjust an intensity of the wireless signal RF_sig at the quarter wavelength. In such a structure, the return loss of the antenna module 7 may be reduced, radiation efficiencies of the radiator 700 may be enhanced, and impedance differences of the antenna module 7 operating in the omni-directional mode and the directional mode may be reduced.

Figure 9:
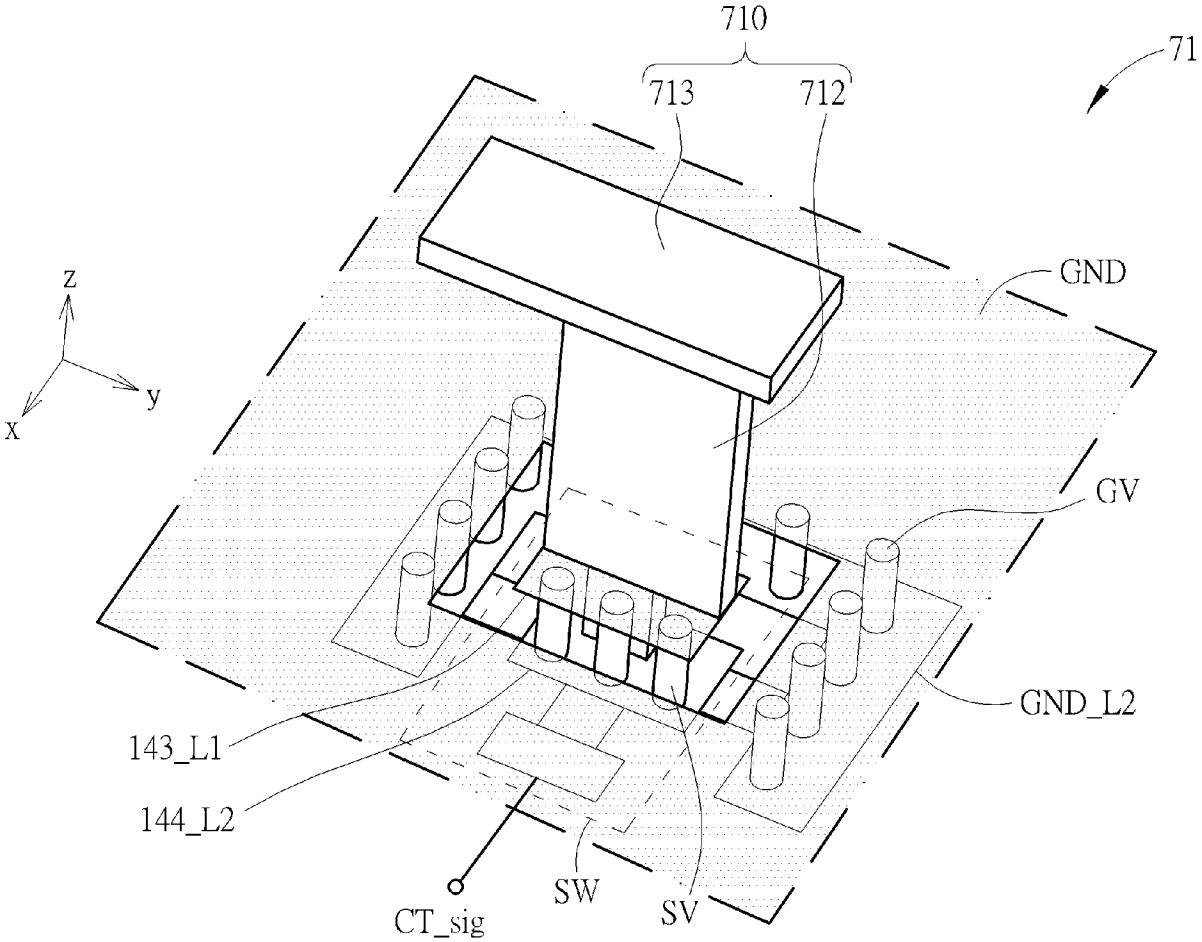
FIG. 9 is a schematic diagram of a reflecting unit in FIG. 7 according to an embodiment of the present invention.

FIG. 9 is a schematic diagram of the reflecting unit 71 according to an embodiment of the present invention. Notably, the reflecting units 71, 72, 73 and 74 illustrated in FIG. 7 are structurally identical, herein takes the reflecting unit 71 for example. As shown in FIG. 9, the reflecting unit 71 includes a reflector 710 and the switch SW. The reflector 710 includes an arm 712 and an arm 713. The arm 712 may be coupled to the switch SW and extend along the z-direction from the switch SW. The arm 713 may be electrically connected to the arm 712 and extend along a direction (y-direction) perpendicular to another direction which is from the omni-directional antenna 70 toward the reflecting unit 71. The reflector 710 may be substantially in a T shape.

Figure 10:
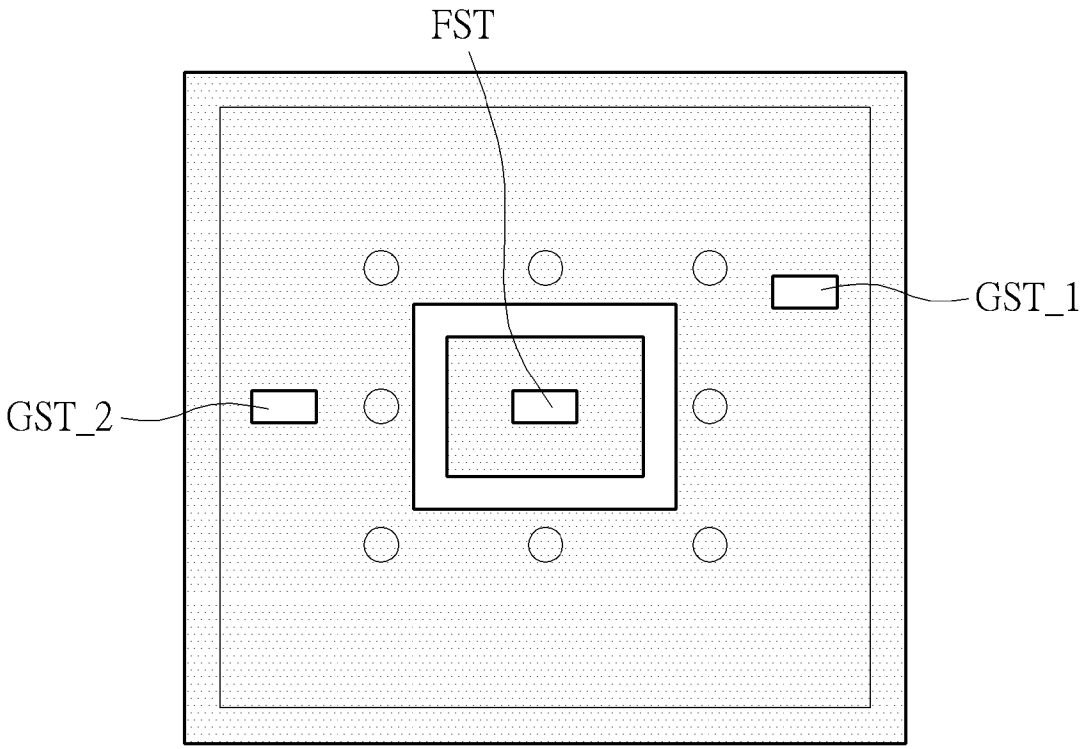
FIG. 10 is a feed structure diagram of the omni-directional antenna in FIG. 7 according to an embodiment of the present invention.

FIG. 10 is a feed structure diagram of the omni-directional antenna 70 according to an embodiment of the present invention. A difference between the feed structures of the omni-directional antennas 10 and 70 is that slots FST, GST_1, GST_2 are formed in the substrate 14 of the omni-directional antenna 70. The arm 701 of the radiator 700 may be inserted into the slot FST, and the arm 703 and the arm 705 may be respectively inserted into the slot GST_1 and the slot GST_2 to fix the arms 701, 703, 705, respectively.

Figure 11:
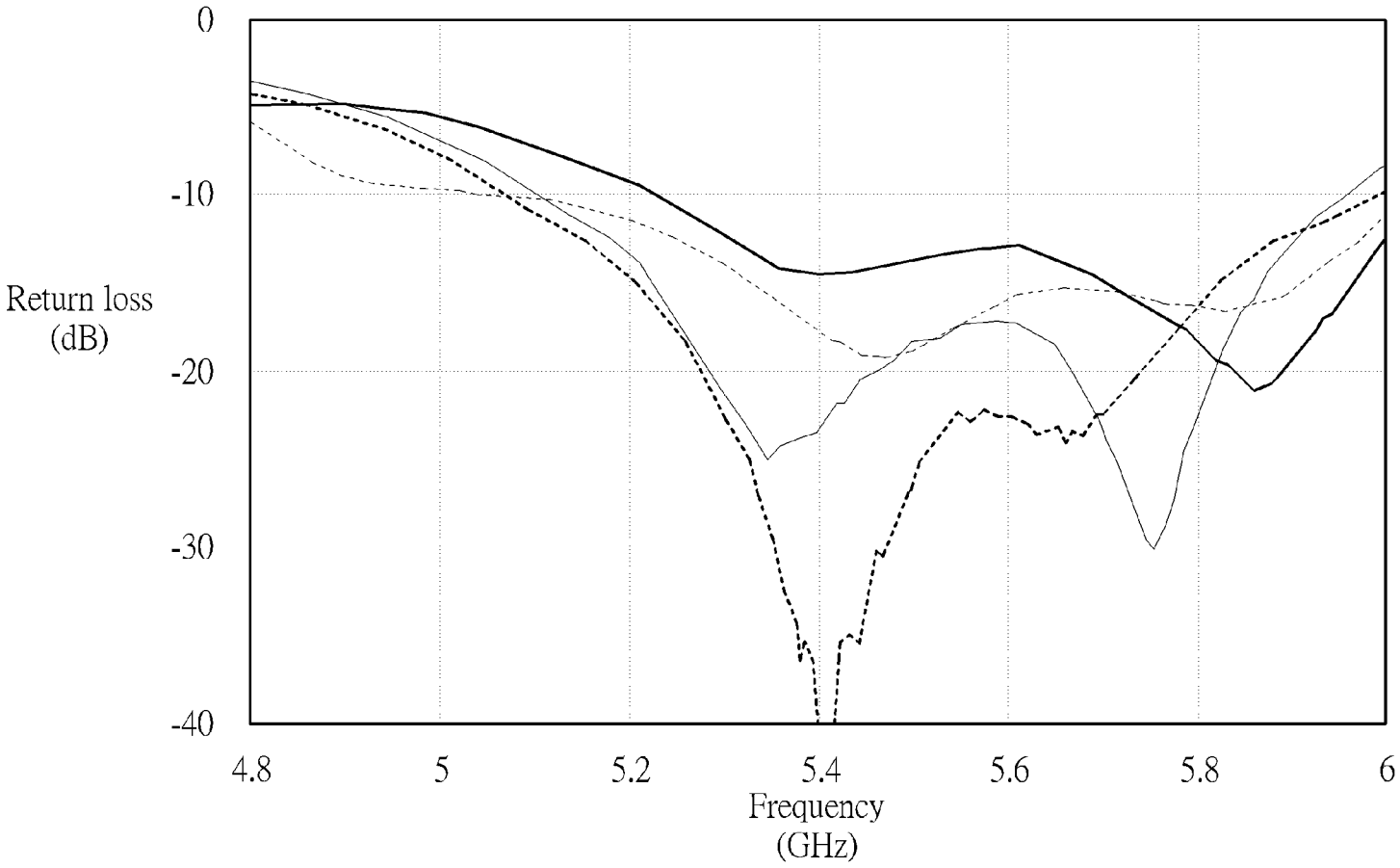
FIG. 11 illustrates a return loss of the smart antenna module in FIG. 1 in 5G frequency band.

FIG. 11 illustrates a return loss of the smart antenna module 1 in FIG. 1 in 5G frequency band (4.9~5.95 GHz) of IEEE 802.11a/n/ac standards. The return loss of the smart antenna module 1 operating in the omni-directional mode is denoted by a thick solid line. The return losses of the smart antenna module 1 operating in the directional mode when the reflecting units 11, 12 and 13 are respectively connected to the ground are denoted by a thin solid line, a dotted line and a thick dotted line, respectively. As shown in FIG. 11, the return losses of the smart antenna module 1 in 4.9 GHz are substantially lower than −4.905 dB (32.32%), and the return losses of the smart antenna module 1 in 5.8 GHz are substantially lower than −10.26 dB (9.41%).

Figure 12:
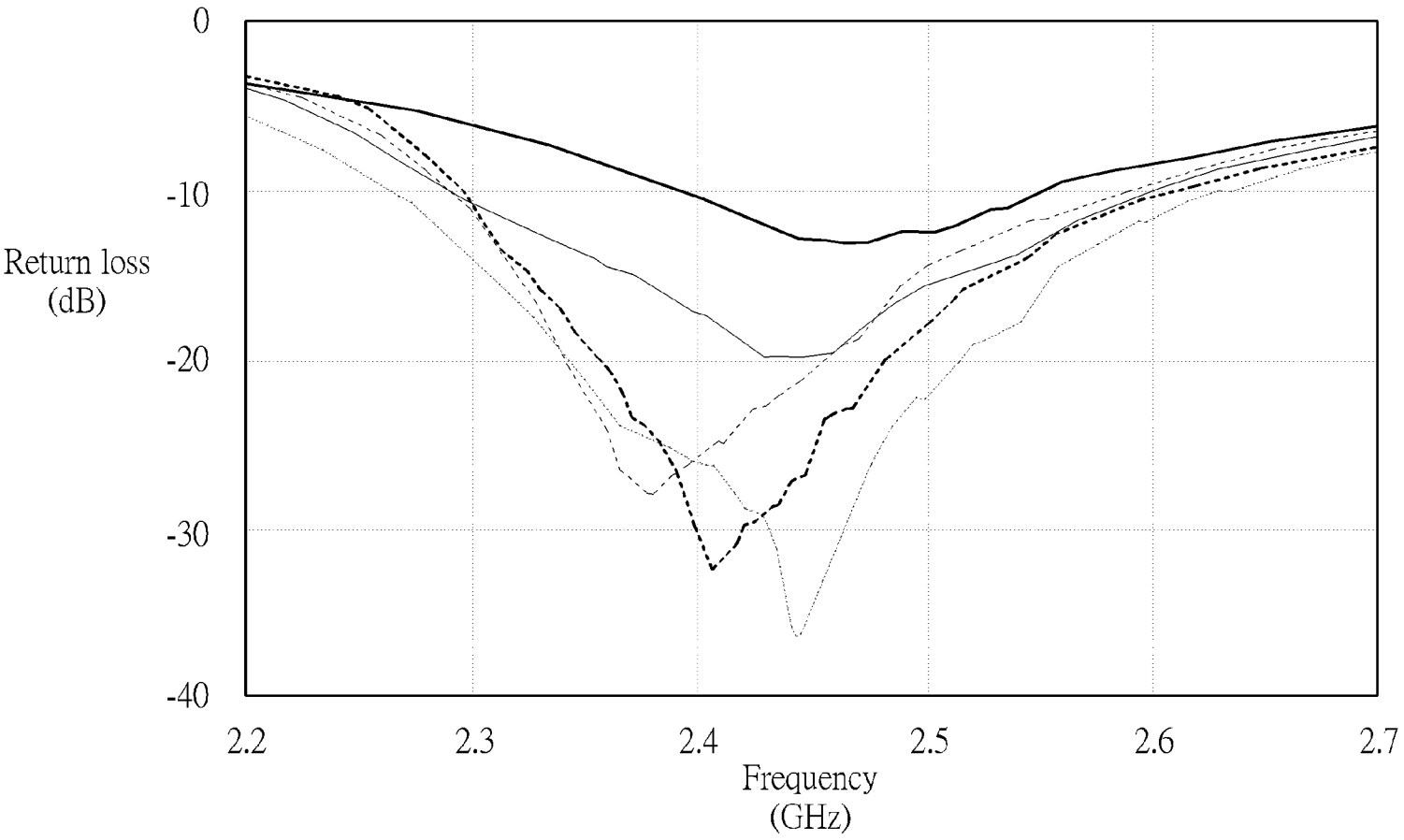
FIG. 12 illustrates a return loss of the smart antenna module in FIG. 7 in 2.4G frequency band.

FIG. 12 illustrates a return loss of the smart antenna module 7 in FIG. 7 in the 2.4G frequency band (2.4~2.5 GHz). The return loss of the smart antenna module 7 operating in the omni-directional mode is denoted by a thick solid line. The return losses of the smart antenna module 7 operating in the directional mode when the reflecting units 71, 72, 73 and 74 are respectively connected to the ground are denoted by a thin solid line, a thin dotted line, a thick dotted line and a thin point line, respectively. As shown in FIG. 12, the return losses of the smart antenna module 1 in 2.4 GHz are substantially lower than −10.45 dB (9.01%), and the return losses of the smart antenna module 1 in 2.5 GHz are substantially lower than −12.36 dB (5.81%).

Figure 13:
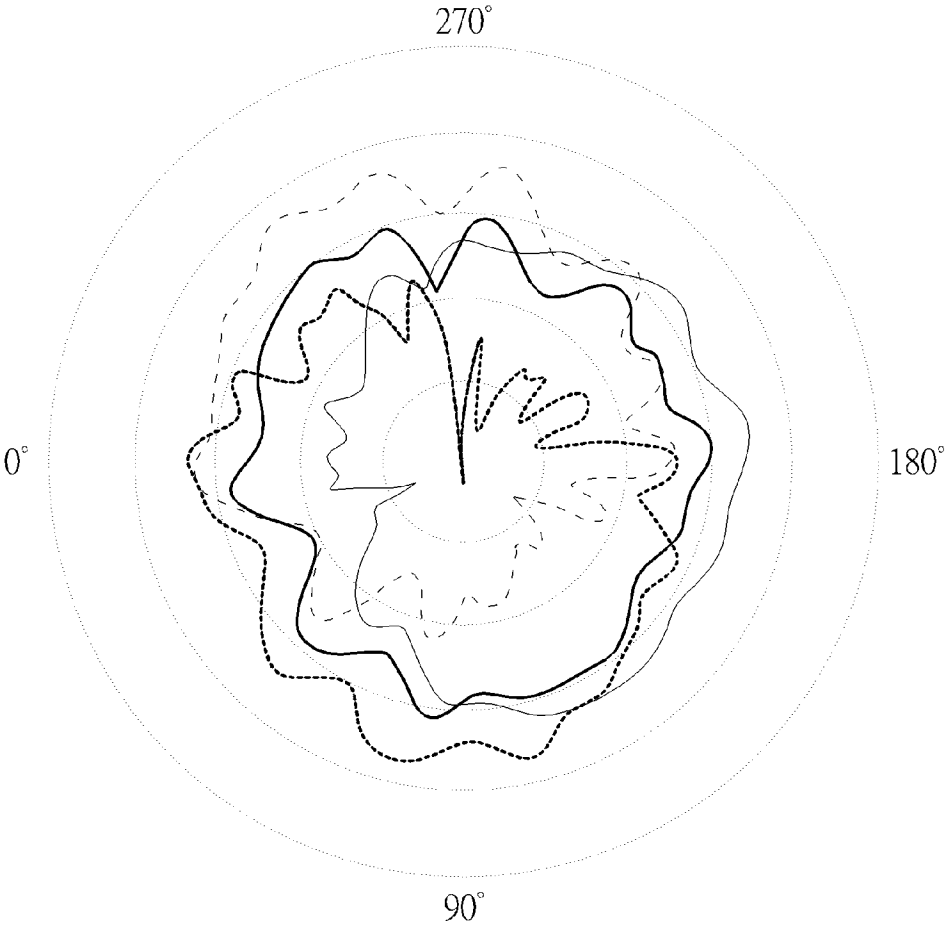
FIG. 13 illustrates a radiation pattern of the smart antenna module in FIG. 1 in an x-y plane in 5G frequency band.

FIG. 13 illustrates a radiation pattern of the smart antenna module 1 in the x-y plane in 5G frequency band. The radiation pattern of the smart antenna module 1 operating in the omni-directional mode is denoted by a thick solid line. The radiation patterns of the smart antenna module 1 operating in the directional mode when the reflecting units 11, 12 and 13 are respectively connected to the ground are denoted by a thin solid line, a dotted line and a thick dotted line, respectively. As shown in FIG. 13, when the reflecting units 11, 12 and 13 are respectively connected to the ground, maximums of the radiation patterns of the smart antenna module 1 are at 180 degrees, 300 degrees and 60 degrees, respectively, i.e., the directions of the main beam.

Figure 14:
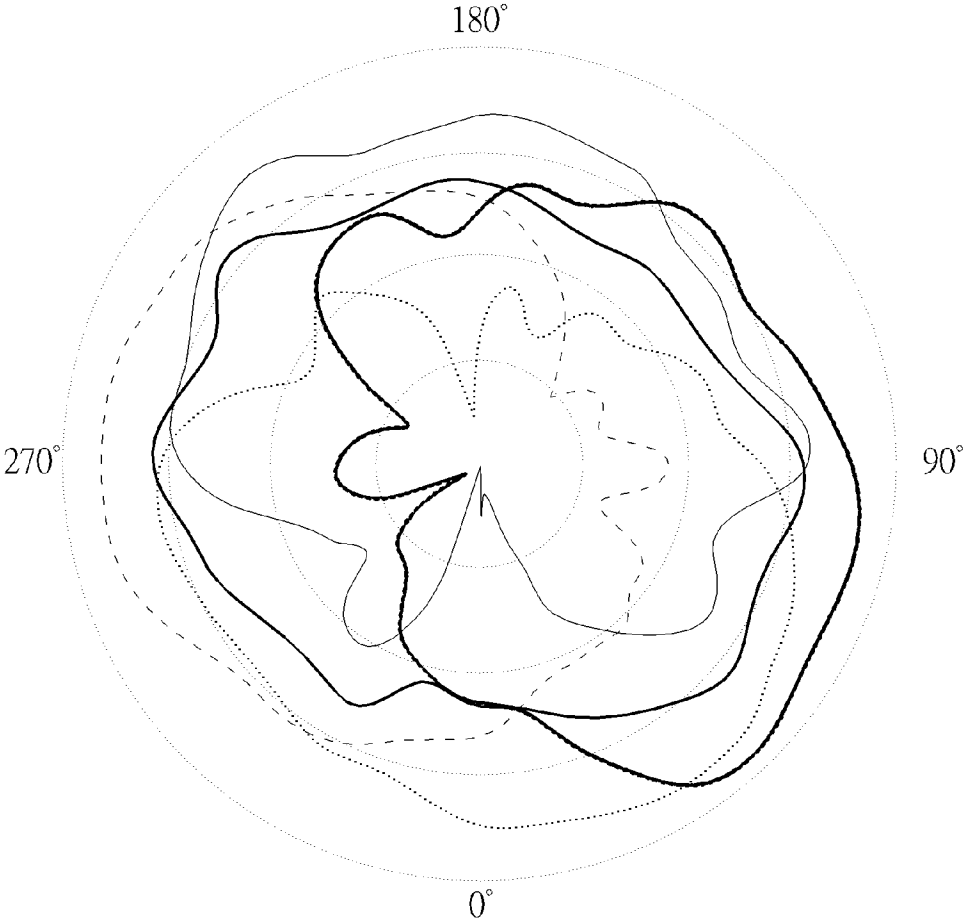
FIG. 14 illustrates a radiation pattern of the smart antenna module in FIG. 2 in an x-y plane in 5G frequency band.

FIG. 14 illustrates a radiation pattern of the smart antenna module 2 in the x-y plane in 5G frequency band. The radiation pattern of the smart antenna module 2 operating in the omni-directional mode is denoted by a thick solid line. The radiation patterns of the smart antenna module 2 operating in the directional mode when the reflecting units 21, 22, 23 and 24 are respectively connected to the ground are denoted by a thin solid line, a thin dotted line, a thin point line and a thick dotted line, respectively. As shown in FIG. 14, when the reflecting units 21, 22, 23 and 24 are respectively connected to the ground, maximum of the radiation patterns of the smart antenna module are at 180 degrees, 270 degrees, 0 degree and 90 degrees, respectively, i.e., the directions of the main beam.

Figure 15:
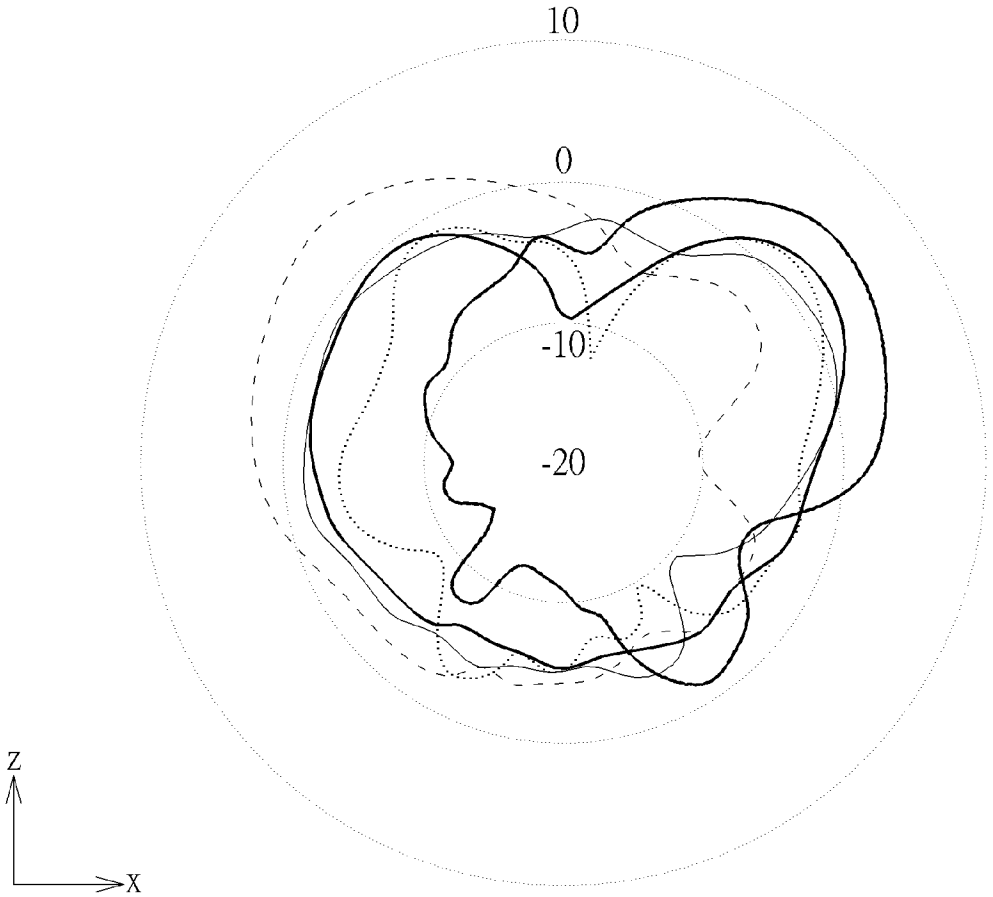
FIG. 15 illustrates a radiation pattern of the smart antenna module in FIG. 7 in an x-z plane in 2.4G frequency band.

FIG. 15 illustrates a radiation pattern of the smart antenna module 7 in the x-z plane in 2.4G frequency band. The radiation pattern of the smart antenna module 7 operating in the omni-directional mode is denoted by a thick solid line. The radiation patterns of the smart antenna module 7 operating in the directional mode when the reflecting units 71, 72, 73 and 74 are respectively connected to the ground are denoted by a thin solid line, a thin dotted line, a thick dotted line and a thin point line, respectively. As shown in FIG. 15, when the reflecting units 71 and 73 are respectively connected to the ground, maximums of the radiation patterns of the smart antenna module 7 are at the x-direction and the opposite direction of the x-direction, i.e., the directions of the main beam on which radiation power of the antenna module 7 is centralized, which also known as a directivity of the antenna.

To sum up, the smart antenna module of the present invention may control the ground state of at least one reflecting unit to adjust the radiation pattern of the smart antenna module. When the smart antenna module is operating in the omni-directional mode, its radiation pattern may be the omni-directional radiation pattern with all of the reflecting units set at floating states. On the other hand, when the smart antenna module operates in the directional mode, its radiation pattern may be a directional radiation pattern toward the direction of the source of the wireless signal. As a result, the smart antenna module may be used as a switched-beam antenna to switch its pattern to be either omni-directional or directional, thereby the co-channel fading may be improved and data throughput of the smart antenna module may be increased.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A smart antenna module, comprising:

an omni-directional antenna; and at least one reflecting unit, for adjusting a radiation pattern of the smart antenna module, wherein each of the at least one reflecting unit comprises:

a reflector; and a switch coupled between the reflector and a ground of the omni-directional antenna for electrically connecting the reflector with the ground or separating the reflector from the ground according to a control signal to adjust the radiation pattern of the smart antenna module;

wherein the omni-directional antenna comprises:

a feed point electrically connected to a wireless signal;

a radiator electrically connected to the feed point for resonating the wireless signal, wherein the radiator comprises:

a first arm electrically connected to the feed point and extending along a first direction from the feed point; and a second arm electrically connected to the first arm and extending along a second direction;

wherein the omni-directional antenna is a T-shaped monopole antenna or a bended-monopole antenna, and the first direction is perpendicular to the second direction.

2. The smart antenna module of claim 1, wherein the radiation pattern of the smart antenna module is an omni-directional pattern and the at least one reflecting unit is set at a floating state, when the smart antenna module is operating in an omni-directional mode, the radiation pattern of the smart antenna module is a directional pattern and the at least one reflecting unit is electrically connected to the ground, when the smart antenna module is operating in a directional mode.

3. The smart antenna module of claim 2, wherein the at least one reflecting unit comprises N reflecting units where N is an integer greater than 1, wherein the radiation pattern of the smart antenna module is an omni-directional pattern and the N reflecting units are set at a floating state when the smart antenna module is operating in an omni-directional mode.

4. The smart antenna module of claim 2, wherein the at least one reflecting units comprises a sole reflecting unit, and a direction of a main beam of the directional pattern is substantially parallel to a direction from the sole reflecting unit toward the omni-directional antenna when the reflecting unit is electrically connected to ground.

5. The smart antenna module of claim 2, wherein the at least one reflecting unit comprises N reflecting units where N is an integer greater than 1, when two adjacent reflecting units of the N reflecting units are electrically connected to the ground, a direction of a main beam of the directional pattern is substantially parallel to a direction from a middle point between the two adjacent reflecting units electrically connected to the ground toward the omni-directional antenna, when (N-1) reflecting units of the N reflecting units are electrically connected to the ground, a direction of a main beam of the directional pattern is substantially parallel to a direction from the omni-directional antenna toward the reflecting unit set at the floating state among the N reflecting units.

6. The smart antenna module of claim 1, wherein the reflector comprises:

a first bend;

a third arm coupled between the switch and the first bend and extending along the first direction from the switch; and a fourth arm having one end electrically connected to the first bend, and another end is open;

wherein the fourth arm extends from the first bend along a direction from the omni-directional antenna toward the reflector, or the fourth arm extends from the first bend along a direction from the reflector toward the omni-directional antenna.

7. The smart antenna module of claim 1, wherein the at least one reflecting unit is disposed around the omni-directional antenna.

8. The smart antenna module of claim 1, further comprising:

a substrate, on which the ground is formed;

a first holder disposed on a first surface of the substrate and coupled to the omni-directional antenna and the reflector of the at least one reflecting unit for fixing the omni-directional antenna and the reflector of the at least one reflecting unit.

9. The smart antenna module of claim 8, further comprising:

a second holder coupled to the reflector of the at least one reflecting unit for fixing the reflector of the at least one reflecting unit.

10. The smart antenna module of claim 1, wherein the switch comprises:

at least one switch device coupled between the reflector and the ground, wherein the at least one switch device is a diode, a transistor or a microelectromechanical system; and a radio-frequency choke device having one end coupled to the control signal, and another end coupled to the at least one switch device and the reflector.

11. A smart antenna module, comprising:

an omni-directional antenna; and at least one reflecting unit, for adjusting a radiation pattern of the smart antenna module, wherein each of the at least one reflecting unit comprises:

a reflector; and a switch coupled between the reflector and a ground of the omni-directional antenna for electrically connecting the reflector with the ground or separating the reflector from the ground according to a control signal to adjust the radiation pattern of the smart antenna module;

wherein the omni-directional antenna comprises:

the ground;

a feed point electrically connected to a wireless signal; and a radiator electrically connected to the feed point and the ground for resonating the wireless signal, wherein the radiator comprises:

a first arm electrically connected to the feed point and extending along a first direction from the feed point;

a second arm electrically connected to the first arm and extending along a second direction from the first arm; and a third arm electrically connected between the second arm and the ground, wherein the third arm comprises:

a first bend;

a first branch electrically connected between the second arm and the first bend and extending along a third direction from the second arm; and a second branch electrically connected between the first bend and the ground and extending along an opposite direction of the first direction from the first bend;

a fourth arm electrically connected to the first arm and extending along an opposite direction of the second direction from the first arm; and a fifth arm electrically connected between the fourth arm and the ground, wherein the fifth arm comprises:

a second bend;

a third branch electrically connected between the fourth arm and the second bend and extending along an opposite direction of the third direction from the fourth arm; and a fourth branch electrically connected between the second bend and the ground and extending along the opposite direction of the first direction from the second bend;

wherein the first direction, the second direction and the third direction are perpendicular to each other.

12. The smart antenna module of claim 11, wherein the first arm has a first length, the second arm and the fourth arm have a second length respectively, and a sum of the first length and the second length is substantially a quarter wavelength of the wireless signal; the third arm and the fifth arm have a third length respectively, and the third length is substantially the quarter wavelength of the wireless signal.

13. The smart antenna module of claim 11, further comprising:

a first open-stub electrically connected to where the second arm is connected to the third arm; and a second open-stub electrically connected to where the fourth arm is connected to the fifth arm.

14. The smart antenna module of claim 11, wherein a combination of the second arm and the first branch of the third arm forms a U-shape having an opening facing the third direction, a combination of the fourth arm and the third branch of the fifth arm forms a U-shape having an opening facing the opposite direction of the third direction, the second branch of the third arm forms a U-shape having an opening facing the opposite direction of the second direction, and the fourth branch of the fifth arm forms a U-shape having an opening facing the second direction.

15. The smart antenna module of claim 11, wherein the reflector comprises:

a sixth arm coupled to the switch and extending along the first direction from the switch; and a seventh arm electrically connected to the sixth arm and extending along a direction perpendicular to another direction from the omni-directional antenna toward the reflecting unit;

wherein the reflector is substantially in T shape.

16. An omni-directional antenna, comprising:

a ground;

a feed point electrically connected to a wireless signal; and a radiator electrically connected to the feed point for resonating the wireless signal, wherein the radiator comprises:

a first arm electrically connected to the feed point and extending along a first direction from the feed point;

a second arm electrically connected to the first arm and extending along a second direction from the first arm; and a third arm electrically connected between the second arm and the ground, wherein the third arm comprises:

a first bend;

a first branch electrically connected between the second arm and the first bend and extending along a third direction from the second arm; and a second branch electrically connected between the first bend and the ground and extending along an opposite direction of the first direction from the first bend;

a fourth arm electrically connected to the first arm and extending along an opposite direction of the second direction from the first arm; and a fifth arm electrically connected between the fourth arm and the ground, wherein the fifth arm comprises:

a second bend;

a third branch electrically connected between the fourth arm and the second bend and extending along an opposite direction of the third direction from the fourth arm; and a fourth branch electrically connected between the second bend and the ground and extending along the opposite direction of the first direction from the second bend;

wherein, the first direction, the second direction and the third direction are perpendicular to each other.

17. The omni-directional antenna of claim 16, wherein the first arm has a first length, the second arm and the fourth arm have a second length respectively, and a sum of the first length and the second length is substantially a quarter wavelength of the wireless signal; the third arm and the fifth arm have a third length respectively, and the third length is substantially the quarter wavelength of the wireless signal.

18. The omni-directional antenna of claim 16, further comprising:

a first open-stub electrically connected to where the second arm is connected to the third arm; and a second open-stub electrically connected to where the fourth arm is connected to the fifth arm.

19. The omni-directional antenna of claim 16, wherein a combination of the second arm and the first branch of the third arm forms a U-shape having an opening facing the third direction, a combination of the fourth arm and the third branch of the fifth arm forms a U-shape having an opening facing the opposite direction of the third direction, the second branch of the third arm forms a U-shape having an opening facing the opposite direction of the second direction, and the fourth branch of the fifth arm forms a U-shape having an opening facing the second direction.

* * * * *